United States Patent [19]

Philpot

[11] Patent Number: 4,940,141

[45] Date of Patent: Jul. 10, 1990

[54] SHRINKWRAP BEVERAGE PACK

[76] Inventor: Terry Philpot, 1532, Chemong Road, R.R.1. Peterborough, Ontario, K9J 6X3, Canada

[21] Appl. No.: 344,749

[22] Filed: Apr. 28, 1989

Related U.S. Application Data

[63] Continuation-in-part of Ser. No. 299,554, Jan. 17, 1989.

[51] Int. Cl.[5] ..... B65D 75/00

[52] U.S. Cl. ..... 206/430; 206/432; 206/497; 206/499; 294/155; 294/157

[58] Field of Search ..... 206/432, 427, 428, 497, 206/499, 430; 294/149, 154, 155, 156, 157

[56] References Cited

U.S. PATENT DOCUMENTS

| | | | |
|---|---|---|---|
| 2,405,517 | 1/1945 | Plummer | 294/149 |
| 2,679,281 | 5/1954 | Paulucci | 206/430 |
| 2,996,180 | 8/1961 | Bruce | 206/432 |
| 3,087,610 | 4/1963 | Kirkpatrick | 206/432 |
| 3,143,266 | 8/1964 | Imatake | 294/154 |
| 3,208,588 | 9/1965 | Mosse et al. | 206/430 |
| 3,255,877 | 6/1966 | Kracht et al. | 206/432 |
| 3,263,806 | 8/1966 | Ring | 206/427 |
| 3,348,674 | 10/1967 | Poupitch | 206/430 |
| 3,392,876 | 7/1968 | Allred | 206/430 |
| 3,422,564 | 1/1969 | Izumi | 206/427 |
| 3,424,306 | 1/1969 | Munck | 206/432 |
| 3,759,373 | 10/1973 | Werth et al. | 206/427 |
| 3,930,578 | 1/1976 | Stein | 206/428 |
| 4,286,711 | 9/1981 | Platt et al. | 206/427 |
| 4,304,332 | 12/1981 | Danti | 206/432 |
| 4,542,826 | 10/1985 | Adams | 206/427 |
| 4,542,930 | 10/1985 | Adams | 206/427 |
| 4,735,313 | 4/1988 | Schoenberg | 206/427 |

FOREIGN PATENT DOCUMENTS

| | | | |
|---|---|---|---|
| 3205756 | 8/1983 | Fed. Rep. of Germany | 206/497 |
| 1450220 | 7/1966 | France | 206/497 |

*Primary Examiner*—Paul T. Sewell
*Assistant Examiner*—Jacob K. Ackun, Jr.
*Attorney, Agent, or Firm*—Richard J. Hicks

[57] ABSTRACT

A package for cans of soft drinks, beer and the like is described. The package comprises a single long sleeve of shrink wrap plastic film within which the cans are stacked one on top of the other. A gap is arranged in the center of the stack so that the sleeve can be folded in half and the juxtaposed sides thereof are joined together by hot glue, and thus forming a handle between the two stacks. In an alternative embodiment the stacked cans are simply held by means of a gummed stretch tape around each pair of cans at the junction thereof.

8 Claims, 4 Drawing Sheets

SHRINKWRAP BEVERAGE PACK

CROSS REFERENCE TO RELATED APPLICATIONS

This application is a continuation-in-part of my earlier filed U.S. application Ser. No. 299554, filed Jan. 17, 1989.

FIELD OF THE INVENTION

This invention relates to a novel packaging package for cans of soft drinks, beer and the like.

BACKGROUND OF INVENTION

Numerous packaging methods and devices employing shrink wrap plastic film have been described. Attention is directed to U.S. Pat. Nos. 4,304,332, 3,255,877 and 3,756,395, all of which illustrate a plurality of cans held in a pack of four or six, by means of shrink wrap plastic, in either overlying or side by side relation. Such packs are, however, relatively difficult to carry as the handle arrangements are either non-existent or merely finger holes which are awkward to use and limit one's carrying capacity. Frequently, one wishes to carry, say, a six pack of beer cans to the beach while also carrying a picnic cooler or beach bag and it would therefore be an advantage to provide a pack having a sufficiently large handle so that the pack can be slipped over the wrist thus leaving the hands free, or even arranging the pack so that it may be hung around the neck or from the shoulder.

OBJECT OF INVENTION

It is, therefore, an object of the present invention to provide a shrink-wrap plastic package for soft drink or beer cans or the like, which is provided with an integrally formed handle so that the pack can easily be held by hand or carried around the neck.

BRIEF SUMMARY OF INVENTION

By one aspect of the invention there is provided a carrier and package assembly for a plurality of cylindrical articles, such as cans, and comprising:

(a) a plurality of articles arranged in longitudinally extending and axially aligned group having a space of at least one article length between adjacent groups;

(b) an open ended heat shrunk endless plastic film envelope means operatively and tightly engaging at least two groups of said articles from top to bottom thereof, so that the film in juxtaposition with said space between groups forms a handle means when a pair of groups are arranged in side-by-side relationship.

By another aspect of this invention there is provided a carrier and package assembly for a plurality of cylindrical articles, such as cans, comprising:

(a) a plurality of articles arranged in longitudinally extending and axially aligned groups having a space of at least one article length between adjacent groups; and (b) a shrink wrap gummed tape extending circumferentially around respective tops and bottoms of adjacent articles in each said group and handle means bridging said space between adjacent groups secured to respective articles by said gummed tape.

DETAILED DESCRIPTION OF PREFERRED EMBODIMENT

Figure 1:
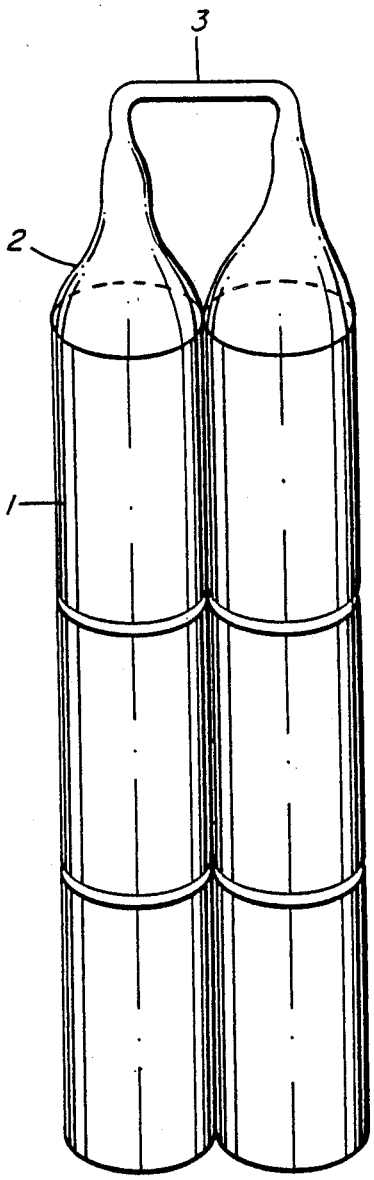
FIG. 1 is a front view of a six pack according to the present invention, with cans in side by side relation.
Figure 2:
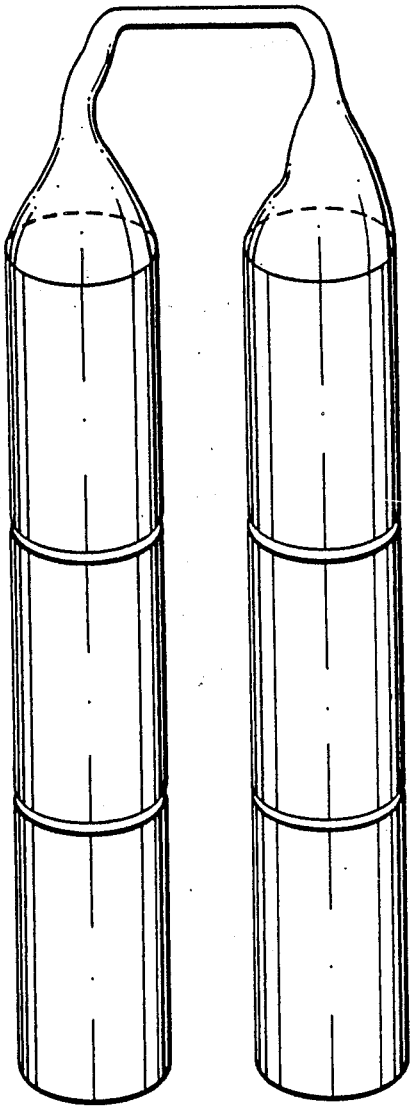
FIG. 2 is a front view of the embodiment of FIG. 1 with the cans in spaced relation.

In FIGS. 1 and 2 there are shown six cylindrical cans 1, which may contain soft drinks, beer or other liquid or solid content generally but not essentially a comestible, as even products such as motor oil are contemplated. The cans 1 are stacked three high one on top of the other in two stacks. The two stacks are contained coaxially within a single longitudinal length of shrink wrap plastic tube 2, such as biaxially oriented polystyrene, polypropylene, polyurethane or polyethylene film material, with a single 3 between each stack of 3. The plastic, is then shrunk around the cans so that they are gripped thereby and the slightly shrunken plastic at space 3, forms a handle when the two stacks of cans are placed in side by side relationship to each other as shown in FIGS. 1 and 2. In the view shown in FIG. 1 and the space 3 provides a loop which can be hand held, and in the view of FIG. 2 the package can be carried on the shoulder, around the neck, over the arm or in the hand.

Figure 3:
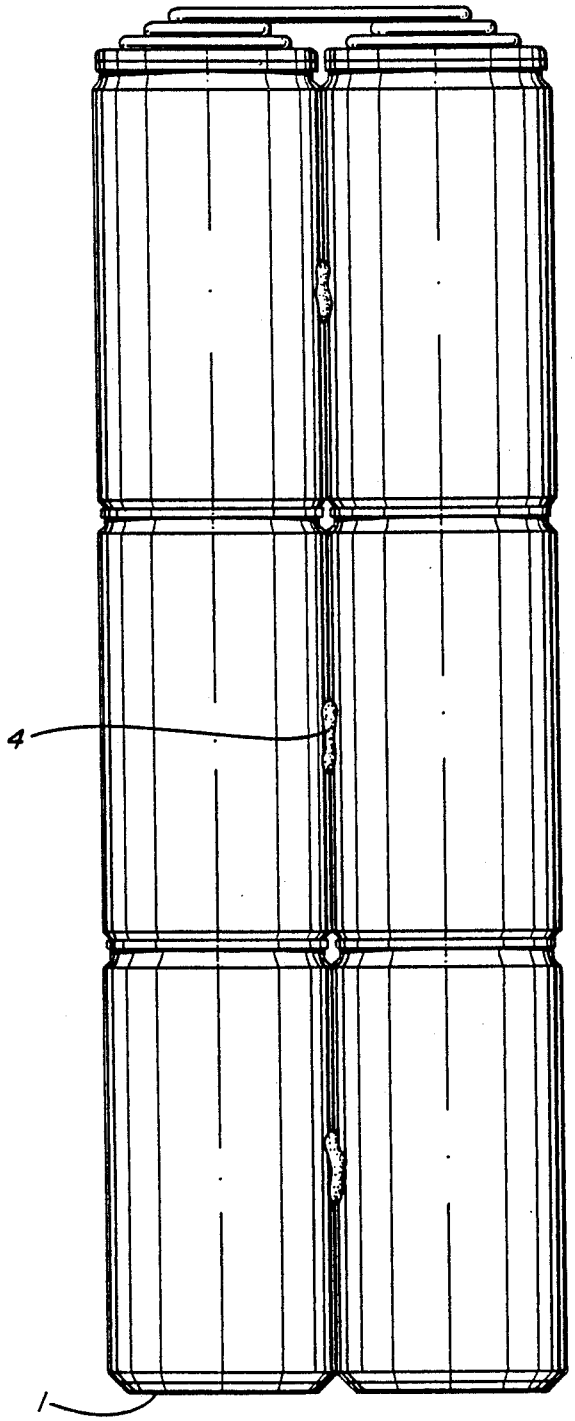
FIG. 3 is a front view of the embodiment of FIG. 1 showing hot glue connection.
Figure 4:
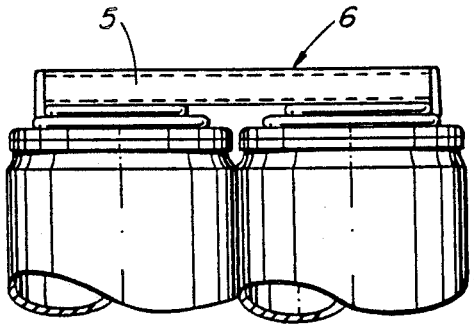
FIG. 4 is a front view of part of an alternative embodiment.

As seen more clearly in FIG. 3, the stacks of cans may be held in juxtaposition by spots of hot melt glue 4 or other adhesive at intervals along the length of the stacks. If it is desired to separate the stacks, moderate lateral pressure may be applied to the stacks to separate them.

Figure 5:
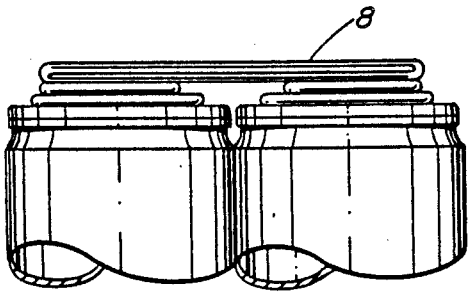
FIG. 5 is a front view of a part of a second alternative embodiment.

In the alternative embodiment shown in FIG. 1 a bar 5 of plastic, wood or metal to form a rigid handle is placed inside the tube 2, during the filling thereof to form a reinforced handle 6. In the embodiment shown in FIG. 5, it is contemplated that a thermoplastic garbage bag 8 is contained in the tube 2 to firstly reinforce the handle portion during carrying and secondly to provide a disposal means for the cans after consumption of their contents.

Optionally, a line of perforations may be provided in the film, adjacent the top of each can to facilitate removal of each can from the pack, or alternatively a tear strip (not shown) may be provided.

It will be appreciated that cans fully enclosed in the tube 2 in the present invention are stored under relatively hygenic conditions and the tops of the cans remain free of dirt and other contaminants making the cans rather more hygenic to drink from than is generally the case with shrink wrap packages. Further, when a can is removed from the pack the plastic surrounding it remains with the can thereby providing some insulation and more particularly reducing the problem of litter disposal.

Figure 6:
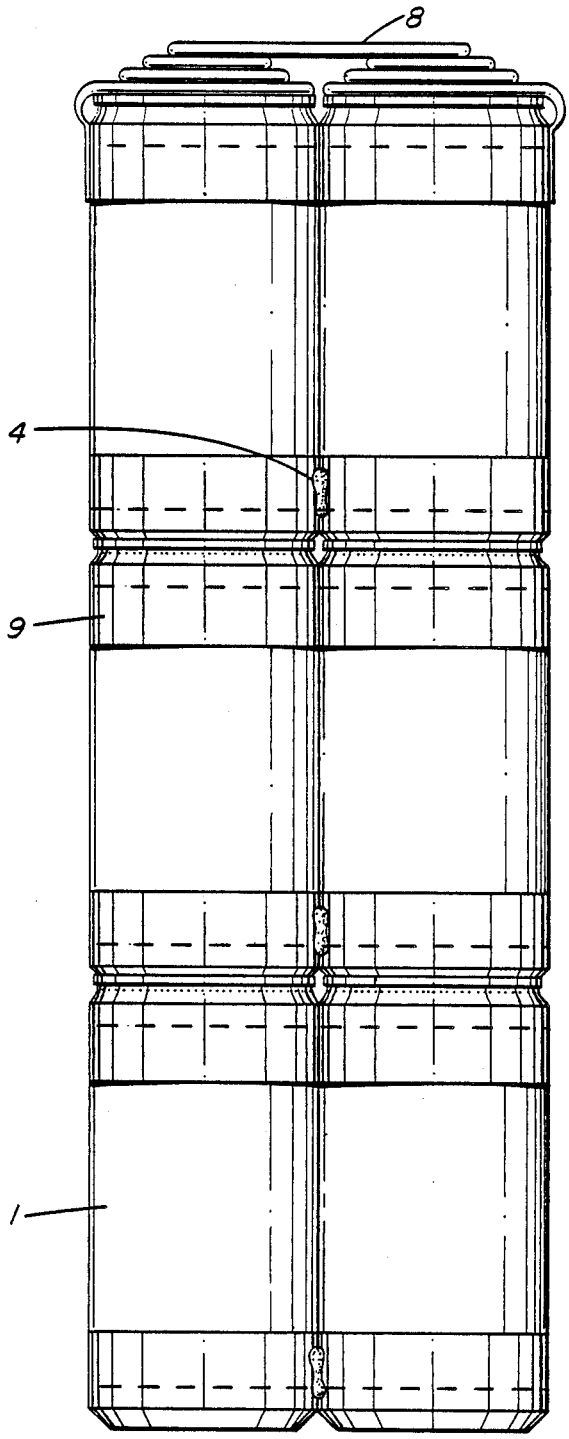
FIG. 6 is a front view of an alternative construction.

In the alternative embodiment shown in FIG. 6, the shrinkwrap plastic tube 2 is replaced by a strip of gummed stretch wrap tape circumferentially around respective ones of the top and bottom of each pair of cans 1 to thereby hold each pair of cans together. A particularly suitable material for this purpose is a clear polyvinyl chloride tape sold by Canadian Technical Tape Inc. of Toronto as Tuck Tape 9235-00 in two inch widths and approximately two mils thick. Preferably three cans are secured together in each stack and pairs of adjacent stacks are connected by a handle 8, formed by a strip of plastic material or, preferably, a folded plastic bag which can be used for disposal of the empty cans secured to the top of the stacks. Each stack of cans may be held to an adjacent stack by means of hot melt glue 4 as before. There may also be a perforation line if desired. This construction has some economies of material but more significantly, it is somewhat easier to construct on high speed continuous machines.

I claim:

1. A carrier and package assembly for a plurality of cylindrical articles, such as cans, and comprising:

(a) a plurality of articles arranged end to end in longitudinally extending and axially aligned groups, said groups being arranged in pairs with their longitudinal axes as being substantially parallel to each other;

(b) an open ended heat shrunk plastic film envelope means operatively, separately and tightly engaging each one of a pair of groups; and (c) handle means integrally formed by a loop of said plastic film interconnecting the groups of each said pair of groups.

2. A package as claimed in claim 1, wherein said pair of groups are held in side-by-side relationship by adhesive means.

3. A package as claimed in claim 2 wherein said adhesive means is a hot melt adhesive.

4. A package as claimed in claim 1, wherein rigid handle means is contained in said envelope in said space between adjacent groups.

5. A package as claimed in claim 1, wherein a garbage disposal bag is contained in said envelope in said space between adjacent groups.

6. A package as claimed in claim 1, including a plurality of circumferential perforations in said film means adjacent one end of each article contained therein.

7. A package as claimed in claim 1, wherein each said group contains three cans.

8. A carrier and package assembly for a plurality of cylindrical articles, such as cans, and comprising:

(a) a plurality of articles arranged end to end in longitudinally extending and axially aligned groups, said groups being arranged in pairs with their longitudinal axes being substantially parallel to each other;

(b) a shrink wrap gummed tape extending circumferentially around respective tops and bottoms of adjacent articles in adjacent pairs of groups; and (c) handle means interconnecting adjacent pairs of groups at one end thereof and secured to a respective article in each group by said gummed tape.

* * * * *